US005906128A

United States Patent [19]

Del Fabro et al.

[11] Patent Number: 5,906,128

[45] Date of Patent: May 25, 1999

[54] DRAWING ASSEMBLY FOR BENDING MACHINES

[75] Inventors: Marcello Del Fabro, Udine; Giorgio Del Fabro, Tricesimo, both of Italy

[73] Assignee: M.E.P. Macchine Elettroniche Piegatricia SpA, Reana del Rojale, Italy

[21] Appl. No.: 08/907,015

[22] Filed: Aug. 6, 1997

[30] Foreign Application Priority Data

Aug. 9, 1996 [IT] Italy ..... UD96A0152

[51] Int. Cl.[6] ..... B21D 3/02

[52] U.S. Cl. ..... 72/161; 72/164; 226/183; 226/189

[58] Field of Search ..... 72/161, 162, 164, 72/165; 226/183, 189, 181, 184, 187

[56] References Cited

U.S. PATENT DOCUMENTS

| | | | |
|---|---|---|---|
| 2,092,840 | 9/1937 | Greene | 72/162 |
| 3,196,656 | 7/1965 | Johnston | 72/162 |
| 3,834,204 | 9/1974 | Ihle | 72/161 |
| 4,876,873 | 10/1989 | Del Fabro | 72/162 |
| 5,440,804 | 8/1995 | Tamura | 29/825 |

FOREIGN PATENT DOCUMENTS

| | | | |
|---|---|---|---|
| 1401984 | 10/1965 | France . | |
| 2522997 | 9/1983 | France . | |
| 454981 | 12/1974 | U.S.S.R. | 72/164 |
| 156957 | 1/1921 | United Kingdom . | |
| 1454738 | 11/1976 | United Kingdom . | |

OTHER PUBLICATIONS

Draht, vol. 38, no. 11, November 1987, Bamberg De, pp. 847–849, XP002027039, Liekmeier: kalibrieren von Drahten in Linie mit Produktionsmaschinen. pp 847, right–hand column, paragraph 2 –page 848, left–hand column, paragraph 1, figure 1.

*Primary Examiner*—Daniel C. Crane

*Attorney, Agent, or Firm*—Antonelli, Terry, Stout & Kraus, LLP

[57] ABSTRACT

Drawing assembly for bending machines used for metal shapes, in particular round pieces (11) for reinforcement purposes or metallic wire, the drawing assembly comprising at least a drawing device placed upstream of the shears (13) and the bending unit (14) and at least a straightening device placed upstream of the drawing device, the drawing device comprising at least a rotary drum having at its periphery a containing seating (19) for the round piece (11), the round piece (11) winding partly onto the rotary drum (17) and within the containing seating (19), the rotating drum (17) being at least 300 mm in diameter, the drawing device (12) comprising at least two contrasting cylinders (18) of a diameter of not more than 180 mm, placed in a position of reciprocal proximity and cooperating with the periphery of the rotary drum (17), the contrasting cylinders (18) acting against the periphery so as to define the arc of winding of the round piece (11) onto the rotary drum (17), there being immediately upstream of the rotary drum (17) a deflection assembly (16) which causes a loop-shaped deformation (20) of the round piece (11) passing through, the loop (20) having an equivalent diameter of at least 800 mm, and the round piece (11) cooperating, at the outlet area of the rotary drum (17), with a first straightening-stretching roll (24).

23 Claims, 1 Drawing Sheet

DRAWING ASSEMBLY FOR BENDING MACHINES

This invention concerns a drawing assembly for bending machines.

The drawing assembly is applied to machines suitable to bend metallic shapes or wire, particularly but not only round pieces or bundles of round pieces used for reinforcing purposes in building work.

Hereafter, in order to simplify the description, we shall refer to bending machines for round pieces although the invention can be applied to bending machines for other shapes.

The state of the art covers bending machines for metallic wires and round pieces for reinforcement purposes comprising a drawing assembly placed upstream of the shears which precedes the bending unit.

The drawing assembly normally comprises, apart from the drawing device, a wire guide device which functions as a first straightening device, and one or more straightening devices which act on the round piece or on the bundle of round pieces before it is subjected to bending.

Normally bending machines have at least two straightening devices arranged on non-parallel planes, in such a way that the correction of the deformations of the round piece is achieved at least in relation to these two planes.

The straightening devices can be arranged upstream, downstream, or both upstream and downstream of the drawing device.

In traditional machines the drawing device is composed of one or more pairs of rolls, counter rotating and arranged in alignment substantially on an axis perpendicular to the longitudinal axis of the round piece passing through.

Drawing assemblies configured in this way have however shown themselves to be not always efficient during the drawing step, also because of the insufficient adherence of the surfaces of the rolls on the round piece.

The round piece, moreover, because of this lack of adherence, is often subject to axial rotations and twistings which can cause considerable problems during the bending step.

If the drawing rolls apply greater compression forces, which is often necessary in order to unwind the round piece from the reel on which it is wound, this does not solve the problem: on the contrary, due to the lack of contact surface between the round piece and the rolls, it often accentuates the problem and causes an unacceptable quality of the final product.

Some recent bending machines have adopted drawing devices which comprise a central rotary drum cooperating with rolls of a smaller diameter arranged on the periphery so as to cooperate with a semi-circumference of the drum.

In this solution, the round piece passing through is forced to make a 180° U-turn before being bent; this causes a better drawing action and an increase in the adherence of the round piece to the drawing device, but on the other hand it has the disadvantage that it guides the round piece back in the direction from which it originally came, and thus makes the structure of the machine complex.

In another solution proposed, the round piece as it advances undergoes two U-turns, the drawing device comprising two rotary drums, cooperating with the relative peripheral rolls, which oblige the round piece to carry out two successive U-turns of 180° before being straightened and subsequently bent.

This type of drawing assembly however is considerably bulky, and requires very powerful driving forces, and is therefore not adaptable to all types of bending machine.

In another type of drawing assembly, the drawing device is composed of two off-set rotary drums, cooperating with the relative peripheral rolls; according to this configuration of the drawing device, the round piece is guided along a travel in a double loop.

In this case the power required and the overall bulk of the components of the drawing device are less than in the previous solution, but on the other hand it is necessary to use one or more wire guide elements in the part of the travel between the two loops, which causes greater costs in achieving the bending machine.

GB-A-1.454.738 shows a drawing device for wire or metallic bars which comprises at least three large drawing rolls, two of which are located on one side of the wire/bar and the other is located on the other side of the wire/bar.

GB '738 also provides that at least one of the three rolls has its axis oscillating elastically in order to regulate the action of thrust and compression on the wire/bar.

Substantially, this solution teaches only to make the wire/bar follow a curved path guided by the rolls; the path can be right-angled (FIG. 1), a double loop (FIG. 2) or a single loop (FIG. 3) with the outlet on the same axis as the inlet to the drawing assembly.

The great size of all the rolls used in the device does not ensure a great contact surface and therefore a sufficient adherence of the wire/bar on the surface of the rolls.

In practice it has been seen that this solution is not satisfactory even when the rolls, as in the case shown in FIG. 3, achieve at the inlet a lever arm which tends to keep the wire/bar in traction and therefore to prevent it from rotating and twisting; in fact, the absence at the outlet of any contrast to the lever arm does not ensure that the wire/bar will maintain the traction condition during the whole step of compression generated by the drawing assembly.

Moreover, the lever effect is partly nullified by the fact that the wire/bar leaves the drawing assembly on the same axis as it enters.

The present applicants have designed, tested and embodied this invention to overcome the shortcomings of the state of the art and to achieve further advantages.

This invention is set forth and characterised in the main claim, while the dependent claims describe variants of the idea of the main embodiment.

The purpose of this invention is to provide a drawing assembly which is efficient both during the straightening step and especially during the step of drawing the round piece/metallic wire, achieving a greater adherence of the drawing device on the round piece/wire in such a way as to prevent it from rotating or twisting.

It is also a purpose of the invention to stabilise the twistings in the wire so that they do not return in the bending step or subsequently in time.

A further purpose of the invention is to provide a drawing assembly where it is easy to replace parts, which has a reduced overall bulk and is easy to run and maintain, and which facilitates and does not interfere with other processing operations, for example, shearing and bending, performed downstream.

The drawing assembly according to the invention comprises a drawing device composed of a large diameter empowered rotary drum arranged on one side of the round piece/wire and at least a pair of contrasting rolls close to each other and cooperating with a section of the periphery of the rotary drum on the other side of the round piece.

According to the invention, the rotary drum has a diameter of at least 300 mm.

In a preferential embodiment, the rotary drum has a diameter of 400÷500 mm.

The contrasting rolls have a maximum diameter of about 180 mm; according to a variant, the contrasting rolls have an interaxis of between 100 and 200 mm.

According to the invention, the drawing device cooperates at the inlet with a deflection assembly and at the outlet with a first straightening roll or stretching device.

According to a variant, the deflection assembly also performs the functions of a straightening assembly.

According to another variant, upstream of the deflection assembly there us a straightening assembly which acts on the round piece/wire on a plane perpendicular to the plane on which the deflection assembly lies.

According to a variant, downstream of the first straightening roll or stretching device there is a straightening assembly which possibly incorporates the first straightening roll.

The deflection assembly is structured in such a way that it causes, in relation to the position of the drawing device, the formation of a wide loop, which may have the form of a chain loop, an arc of a circle, or a polynomial curve.

The loop, which compared with an arc of a circle has an equivalent diameter of at least 800 mm, is applied to the round piece/wire passing through, before the round piece/wire again takes a substantially rectilinear direction in correspondence with the assemblies arranged between the drawing device and the shears placed upstream of the bending unit and downstream of the drawing device.

The wide loop causes the formation of a first lever arm which guarantees the drawn round piece will be kept in traction and prevents it from possibly rotating or twisting; the drawing device then fixes the intrinsic rotating and twisting movements onto the round piece/wire in a stable manner.

According to a variant, this action performed by the lever arm is accentuated by the fact that the round piece/wire leaving the drawing device has the inlet axis parallel but not coincident with the outlet axis.

According to another variant of the invention, the assemblies arranged downstream of the drawing device create a counter-loop on the round piece or wire as it leaves the drawing device in such a way that it brings the round piece/wire substantially back onto the inlet axis, thus creating a double lever arm and further accentuating the stabilisation of the twisting movements.

According to a further variant, the outlet axis is inclined with respect to the inlet axis by a desired angle.

According to the invention, at the immediate outlet of the rotary drum there is the first straightening roll-stretching device which acts as a contrasting element to the lever arm constituted by the deflection assembly upstream.

According to a variant, it is possible to adjust the position of the axis of the first straightening-roll stretching device with respect to the plane on which the round piece/wire passing through lies.

Downstream of the first straightening roll-stretching device, according to the invention there is a measuring assembly consisting of a pair of rolls counter opposed lying on the plane on which the round piece/wire lies.

The tangent to the lower roll of the measuring assembly and to the rotary drum of the drawing device defines substantially the line of transit of the round piece/wire which is to be drawn.

According to the invention, the first straightening-stretching roll, arranged on the opposite side of the rotary drum with respect to the round piece/wire and in an intermediate position between the rotary drum and the measuring assembly, may be taken below the transit line, by desired and controlled values, in order to impart to the round piece/wire the desired stretching effect.

This action of the first straightening-stretching roll, according to the result desired and to the characteristics of the round piece/wire to be drawn, exerts a more or less accentuated contrast against the lever arm constituted by the deflection assembly located upstream of the drawing device.

According to a variant, at the outlet of the drawing device and on the side of the rotary drum there is a guide element for the round piece/wire.

In a first embodiment, the guide element is a stationary pad or similar element.

According to a variant, the guide element is a roll.

According to another variant, the first straightening-stretching roll is arranged on the side of the rotary drum of the drawing device.

The measuring assembly is advantageously followed, according to a further variant, by a straightening roll arranged on the same side as the first straightening-stretching roll with respect to the round piece passing through; it is movable both on the plane on which the round piece lies, and also on the plane perpendicular thereto, in order to perform the function of straightening the round piece both with respect to the horizontal plane and the perpendicular plane.

According to a further variant, there is a first straightening roll acting on the plane parallel to the plane on which the round piece in transit lies and a second straightening roll acting on the plane perpendicular to the plane on which the round piece lies.

According to a variant, since there is the straightening roll action on the plane perpendicular to the plane on which the round piece lies, the straightening assembly is not included on the perpendicular plane located upstream of the drawing device.

The combination of the assemblies which constitute the drawing assembly makes it possible to obtain a highly efficient drawing action and also a complete stabilisation of the twisting actions in the round piece/wire.

Moreover, the increased size of the rotary drum of the drawing device makes it possible to create, on the rotary drum itself, a deeper containing seating for the round piece/wire, thus increasing the adherence of the round piece to the drum, making the action of the drawing device more efficacious.

According to a variant, the containing seating of the round piece is defined on a plurality of plates, made of an anti-wear material of great hardness and resistance to pressure, and mounted on the periphery of a central body which constitutes the bearing structure of the rotary drum; in this way the costs of achieving the drawing device are reduced and also more generally of the whole drawing assembly, as the central body of the rotary drum can be built in a material of lesser quality.

It is also possible to contain the construction costs of the drawing assembly according to the invention because of the limited need to supply wire guide elements, as the straightening devices are placed behind the drawing device and the latter is placed near the bending unit; moreover this configuration causes a considerable reduction in the bulk volume of the drawing assembly, thus allowing considerably more compact bending machines to be produced.

The attached tables, which are given as a non-restrictive example, show a preferred embodiment of the invention as follows.

Figures 1, 2, 3:
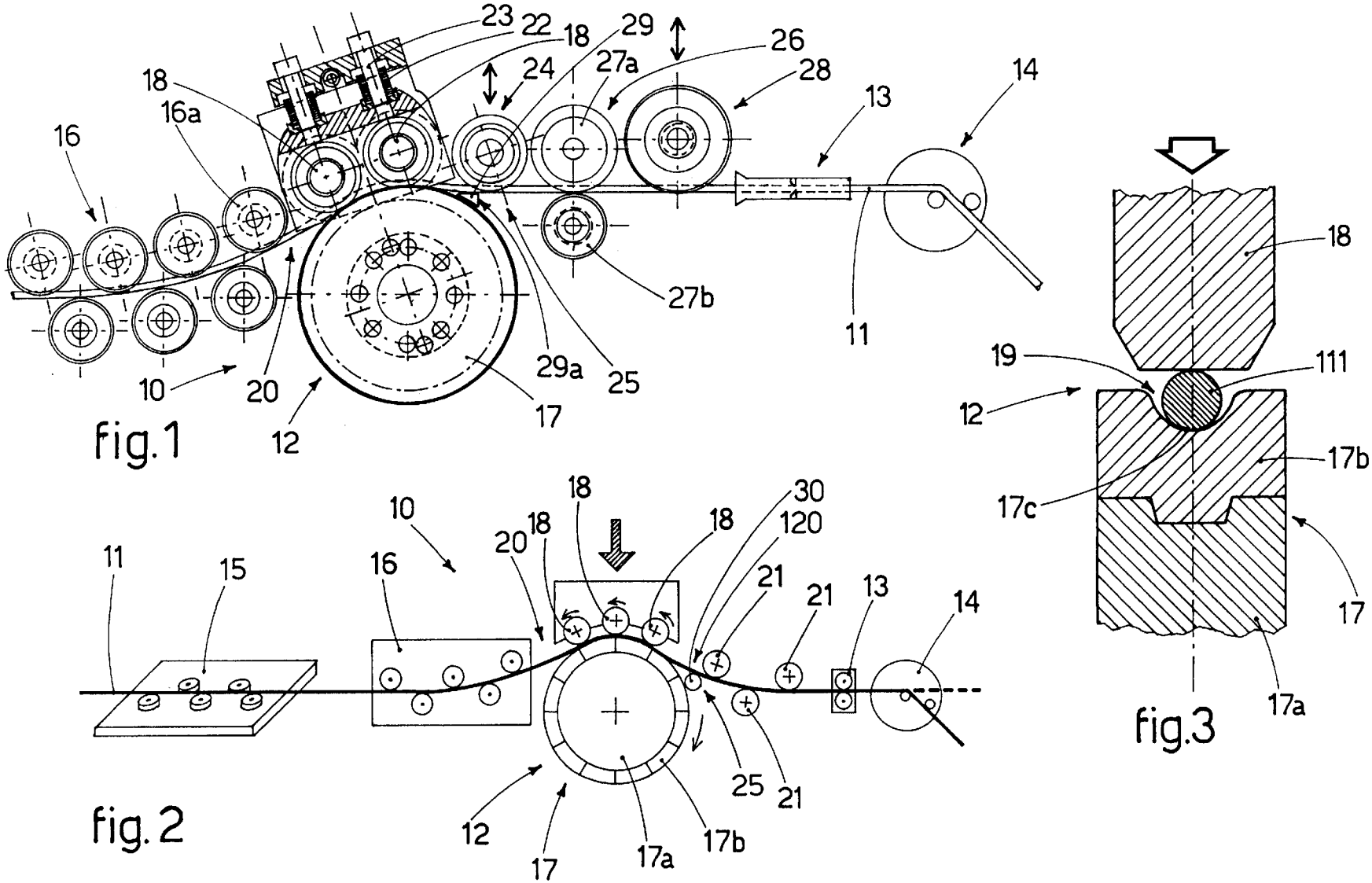
FIG. 1 is a diagram of the drawing assembly for bending machines according to the invention.
FIG. 2 is a diagram of a variant of the drawing assembly shown in FIG. 1.
FIG. 3 is a partial view of a section of the drawing device shown in FIG. 2.

The reference number 10 in the figures denotes generally the drawing assembly according to the invention for bending machines for bending metal shapes, in this case round pieces 11 used for reinforcement purposes in building work.

The drawing assembly 10 comprises a drawing device 12, and, in this case, it is positioned upstream of the shears 13 and in a position near the bending unit 14.

According to the invention, the drawing device 12 comprises an empowered rotary drum 17 of large diameter (at least 300 mm, preferably 400÷500 mm), made of an anti-wear metallic material, of great hardness and resistance to compression, such as for example a special and/or treated steel.

This rotary drum 17 has, on its outer surface, a circumferential cavity defining the containing seating 19 of the round piece 11 and cooperates peripherally with contrasting cylinders 18, in this case two, which rotate in the opposite direction to the drum 17, the cylinders being pressed against the round piece 11.

According to the variant shown in FIGS. 2 and 3, the rotary drum 17 is composed of a central body 17*a*, associated with the axis of rotation, made of a non-specified material, on which a plurality of plates 17*b* are radially mounted; the plates 17*b* are made of an anti-wear material of great hardness and resistance to compression, and the containing seating 19 for the round piece is achieved on the plates 17*b*.

In this case, as shown in FIG. 1, the contrasting cylinders 18 are idler cylinders and pressed elastically against the periphery of the rotary drum 17 by the elastic elements 22 which cooperate with the assembly shaft 23 oriented radially to the rotary drum 17.

In FIG. 1, there are two contrasting cylinders 18, placed substantially in reciprocal contact; moreover, they cooperate substantially with the inlet quadrant of the rotary drum 17.

The round piece 11 is fed by the counter rotation of the rotary drum 17 and the contrasting cylinders 18, which thrust the round piece 11 against the rotary drum 17 and accentuate the condition of contact between the rotary drum 17 and the round piece 11, and increasing the surface of adherence of the round piece 11 against the surface of the rotary drum 17.

This is also due to the fact that the greater diameter of the rotary drum 17 makes it possible to achieve a very deep containing seating 19 for the round piece 11, thus increasing the amount of the contact surface 17*c* and therefore the adherence between the rotary drum 17 and the round piece 11.

The drawing device 12 cooperates with a deflection assembly 16 positioned upstream of the drawing device 12; it also has the function of re-establishing the rectilinear condition of the round piece 11 as it unwinds from the reel.

In the variant shown in FIG. 2, upstream of the deflection assembly 16 there is a straightening device 15 which acts on a perpendicular plane with respect to the deflection assembly 16; these two assemblies 15 and 16 exert their straightening function on respective planes which are perpendicular to each other.

According to the invention, the deflection assembly 16 is arranged upstream and behind the rotary drum 17. The deflection assembly 16 is arranged in such a way, in relation to the drawing device 12, as to cause the formation on the round piece 11 of a wide loop 20 of a desired curve (with an equivalent diameter of at least 800 mm, preferably 1000 mm and more) which extends substantially continuously from the deflection assembly 16 to the drawing device 12.

The last roll 16*a* of the deflection assembly 16 is located (see FIG. 1) very near the first contrasting cylinder 18.

The deflection assembly 16 also functions as a lever arm with respect to the drawing device 12 in order to keep the round piece in traction and prevent it from rotating and twisting.

The contrasting function of the deflection assembly 16 is performed by a first straightening-stretching roll 24 acting on the round piece 11 at the outlet of the rotary drum 17 and arranged on the opposite side with respect to the rotary drum 17.

The first straightening-stretching roll 24 cooperates downstream with a measuring assembly 26 consisting of a pair of counter opposed rolls 27*a* and 27*b*.

According to a variant, the measuring assembly 26 may be placed upstream of the drawing device 12 or in a desired position upstream of the shears 13, there always being included a contrasting roll 27*b* or equivalent downstream of the first straightening-stretching roll 24.

The lower roll 27*b* is arranged aligned with the rotary drum 17 so that their tangent defines the line of transit of the round piece 11.

It is possible to adjust the position of the first straightening-stretching roll 24 with respect to the plane on which the round piece 11 lies, in order to impart a more or less accentuated stretching effect on the round piece 11 by lowering the roll 24 to a greater or lesser degree below the transit line defined by the tangent plane which connects the rotary drum 17 with the lower roll 27*b* of the measuring assembly 26.

The first straightening-stretching roll 24 also functions as a contrast and counterstroke to the lever arm formed by the deflection assembly 16, thus guaranteeing that the round piece 11 will be kept in traction all the time it is cooperating with the rotary drum 17, and ensuring that the round piece 11 will remain compressed inside the seating 19 of the rotary drum 17 without rotating or twisting.

The outlet axis of the round piece 11 from the drawing device 12 does not coincide with the inlet axis; this intensifies the lever effect exerted between the deflection assembly 16 and the first straightening-stretching roll 24.

In the embodiment shown in FIG. 1, at the outlet of the rotary drum 17 there is guide element 25 consisting of a stationary pad 29 which serves to guide the round piece 11 between the rotary drum 17 and the lower roll 27*b* of the measuring assembly 26, particularly during the introduction step.

The rear end 29*a* of the stationary pad 29 is located upstream of the zone of contact between the first straightening-stretching roll 24 and the round piece 11.

In the variant shown in FIG. 3, the guide element 25 consists of a roll 30.

According to a variant which is not shown here, the first straightening-stretching roll 24 is arranged on the same side as the rotary drum 17.

Downstream of the measuring assembly 26 there is a straightening roll 28 located on the same side, with respect to the round piece 11, as the first straightening-stretching roll 24.

The straightening roll 28 maintains the alignment of the round piece 11 as it leaves the drawing device 12 and sends it to the shears 13 and to the bending unit 14.

The straightening roll 28 can be moved, in this case, parallel to the plane on which the round piece 11 in transit lies.

Downstream of the straightening roll 28 there is, in this case, a straightening roll 31 which can be moved on a plane perpendicular to the plane on which the round piece 11 lies and which exerts its straightening action on a plane perpendicular to the straightening plane of the roll 28.

The inclusion of the straightening roll 31 means that it is not necessary to include the specific straightening assembly 15 upstream of the drawing device 12.

According to a variant, there is only the straightening roll 28 which is able to move both on the plane on which the round piece 11 lies and also on a plane perpendicular thereto, in order to exert on the round piece 11 a straightening action on both these planes.

The movement of the straightening roll 28 on the plane parallel to the plane on which the round piece 11 lies exerts on the round piece 11 an inverse component with respect to the drawing action exerted by the drawing device 12; this increases the traction effect and the anti-rotation effect on the round piece 11.

According to the variant shown diagrammatically in FIG. 2, the rolls 24 and 28 and the measuring assembly 26 are shown as rolls 21; they are arranged not aligned with the tangent plane above the rotary drum 17 causing, on the round piece 11 downstream of the drawing device 12, the formation of a counter-loop 120 which brings the round piece 11 back to a substantially rectilinear direction on the same inlet plane before being sent to the bending unit 14.

According to the invention, the contrasting cylinders 18 have a diameter of between about 80 and 180 mm and a reciprocal interaxis of between about 100 and 200 mm.

We claim:

1. Drawing assembly for bending machines used for metal pieces for reinforcement purposes or metallic wire, the drawing assembly comprising at least a drawing device and at least a first straightening-stretching roll downstream of the drawing device, the drawing device comprising at least a rotary drum having at its periphery a containing seating for the metal piece, the metal piece winding partly onto the rotary drum and within the containing seating, the assembly being characterized in that the rotary drum is at least 300 mm in diameter, that the drawing device comprises at least two contrasting cylinders of a diameter of not more than 180 mm, placed in a position of reciprocal proximity and cooperating with the periphery of the rotary drum, the contrasting cylinders acting against the periphery so as to define the arc of winding of the metal piece onto the rotary drum, and that immediately upstream of the rotary drum there is a deflection assembly which causes a loop-shaped deformation of the metal piece passing therethrough and onto the rotary drum, the loop having an equivalent diameter of at least 800 mm and that the metal piece cooperates, at the outlet area of the rotary drum, with the first straightening-stretching roll.

2. Drawing assembly as in claim 1, in which the first straightening-stretching roll can be moved at least on a plane parallel to the plane on which the metal piece lies.

3. Drawing assembly as in claim 1, in which the first staightening-stretching roll is arranged on the same side, with respect to the metal piece, as the contrasting cylinders.

4. Drawing assembly as in claim 1, in which the first staightening-stretching roll is arranged on the same side, with respect to the metal piece, as the rotary drum.

5. Drawing assembly as in claim 1, in which the axis of the metal piece leaving the drawing device is parallel to and not coincident with the axis of the metal piece as it enters the drawing device.

6. Drawing assembly as in claim 1, in which the axis of the metal piece leaving the drawing device is substantially coincident with the axis of the metal piece as it enters the drawing device.

7. Drawing assembly as in claim 1, in which the axis of the metal piece leaving the drawing device is inclined according to a desired angle to the axis of the metal piece as it enters the drawing device.

8. Drawing assembly as in claim 1, in which downstream of the first straightening-stretching roll there is a contrasting roll.

9. Drawing assembly as in claim 8, in which the tangent to the contrasting roll and the rotary drum defines the outlet axis of the metal piece.

10. Drawing assembly as in claim 1, in which there is a measuring assembly including counter opposed rolls.

11. Drawing assembly as in claim 1, in which upstream of the drawing device there is at least a straightening device.

12. Drawing assembly as in claim 11, in which the straightening device consists of the deflection assembly.

13. Drawing assembly as in claim 1, in which downstream of the drawing device there is at least a straightening device.

14. Drawing assembly as in claim 13, in which the straightening device downstream of the drawing device comprises a straightening roll arranged downstream of the measuring assembly and can be moved on a plane parallel to the plane on which the metal piece lies.

15. Drawing assembly as in claim 14, in which the straightening roll can be moved also perpendicularly to the plane on which the metal piece lies.

16. Drawing assembly as in claim 13, in which the straightening device comprises a first straightening roll which can be moved parallel to the plane on which the metal piece lies and a second straightening roll which can be moved perpendicular to the plane on which the metal piece lies.

17. Drawing assembly as in claim 1, in which at the outlet of the drawing device there is a guide element arranged on the side of the rotary drum.

18. Drawing assembly as in claim 17, in which the guide element consists of a stationary pad with rear end placed upstream of the area of contact between a first straightening-stretching roll and the metal piece.

19. Drawing assembly as in claim 17, in which the guide element consists of a roll.

20. Drawing assembly as in claim 1, in which the deflection assembly comprises and the last roll of the deflection assembly is placed upstream of a contrasting cylinder and on the same side there as.

21. Drawing assembly as in claim 1, in which the contrasting cylinders are associated with elastic contrasting means.

22. Drawing assembly as in claim 1, in which the interaxis between the contrasting cylinders is between 100 and 200 mm.

23. Drawing assembly as in claim 1, in which the rotary drum consists of a central body associated with the axis of rotation and of a plurality of plates arranged peripherally to the central body and made of an anti-wear material, the plates defining the containing seating for the metal piece.

* * * * *